United States Patent [19]

Jacobson et al.

[11] 4,163,708

[45] Aug. 7, 1979

[54] PROCESS FOR THE REMOVAL OF THIOLS FROM HYDROCARBON OILS

[75] Inventors: Robert L. Jacobson, Pinole; K. R. Gibson, El Cerrito, both of Calif.

[73] Assignee: Chevron Research Company, San Francisco, Calif.

[21] Appl. No.: 892,544

[22] Filed: Apr. 3, 1978

Related U.S. Application Data

[63] Continuation of Ser. No. 788,041, Apr. 15, 1977, abandoned, which is a continuation of Ser. No. 591,090, Jun. 27, 1975, abandoned.

[51] Int. Cl.[2] ..... C10G 29/06; C10G 23/00

[52] U.S. Cl. ..... 208/89; 208/246; 208/91

[58] Field of Search ..... 208/89, 246, 91, 88, 208/97, 79

[56] References Cited

U.S. PATENT DOCUMENTS

| | | | |
|---|---|---|---|
| 2,755,227 | 7/1956 | Lucas | 208/89 |
| 2,917,452 | 12/1959 | Brooke et al. | 208/246 |
| 3,175,966 | 3/1965 | Burch | 208/79 |
| 3,185,639 | 5/1965 | Paterson | 208/79 |
| 4,113,606 | 9/1978 | Mulaskey | 208/246 |

FOREIGN PATENT DOCUMENTS

| | | | |
|---|---|---|---|
| 2119803 | 11/1974 | France | 208/246 |

*Primary Examiner*—George Crasanakis

*Attorney, Agent, or Firm*—D. A. Newell; R. H. Davies; D. L. Hagmann

[57] ABSTRACT

Thiol impurities are removed from hydrocarbon oils by contacting the oil with a scavenger at a temperature in the range of about 120° to 400° C. The scavenger is a composite having a copper component and an inorganic porous carrier component and having a surface area in the range 20 to 1000 square meters per gram. The contacting must be with the scavenger below its thiol-sulfur end point.

10 Claims, No Drawings

PROCESS FOR THE REMOVAL OF THIOLS FROM HYDROCARBON OILS

This is a continuation of application Ser. No. 788,041 (abandoned), filed Apr. 15, 1977 which is a continuation of application Ser. No. 591,090, filed June 27, 1975 (abandoned).

BACKGROUND OF THE INVENTION

This invention relates to a process for improving a hydrocarbon oil by removing thiol sulfur from the oil. More particularly, it relates to the removal of such sulfur by contacting the oil with a copper-containing scavenger under suitable conditions.

PRIOR ART

It is known in the art to improve a thiol-containing hydrocarbon stream by converting the thiol impurity to a relatively "sweet" organic disulfide (see for example U.S. Pat. Nos. 2,755,226 and 2,769,764). It is also known to improve a thiol-containing hydrocarbon stream by oxidizing the thiol components of the stream using molecular oxygen and a copper-containing oxidation catalyst (see for example U.S. Pat. Nos. 2,338,371, 2,653,125 and 3,192,152). In these processes, the thiol is also converted to the disulfide which is included in the product obtained from the process. Thus in both of the foregoing process methods, only the form of the sulfur is changed and relative to sulfur impurity content, the resulting product remains objectionable on the basis of its sulfur content. Under contemporary environmental standards, the presence of sulfur in a hydrocarbon, particularly where it is to be used as a fuel, is undesirable because of the sulfur content of the exhaust stream from combustion of the fuel.

In a yet further process for the improvement of hydrocarbon oils by sweetening, it is known to convert thiol impurities to oil-soluble copper mercaptides under ambient or moderate temperature condition and to remove these mercaptides from the hydrocarbon oil by contact with a suitable absorbent, for example a heavy metal sulfosilicate, pumice, clay, silica gel, kieselguhr, Fuller's earth, boria, and the like. The presence of oil-soluble copper compounds in a hydrocarbon oil is undesirable for a variety of reasons, including: (1) a destabilizing effect which copper compounds have upon hydrocarbon oils on standing; and (2) where the oil is to be subjected to downstream processing using a catalyst, copper impurities are frequently found to exert deleterious effects upon the catalyst. For example, where the hydrocarbon oil is to be subjected to reforming using a platinum reforming catalyst, copper impurities have been found to seriously reduce the activity of the reforming catalyst.

SUMMARY OF THE INVENTION

The present invention is a process for removing thiol impurity from a hydrocarbon oil boiling in the range from about 10° C. to about 300° C., having a total sulfur-containing-impurity content, calculated as elemental sulfur, in the range below about 1000 ppm, including at least 0.2 ppm of thiol impurity which comprises reducing said thiol content by at least 50% by contacting the oil in the substantial absence of molecular oxygen with a scavenger at a temperature in the range from about 120° to 400° C. The scavenger comprises an essentially oil-insoluble solid composite having a copper component and an inorganic porous carrier component and having a surface area in the range from about 20 to 1000 square meters per gram. The copper component is selected from the group consisting of copper metal and copper compounds. The carrier component is selected from the group consisting of refractory metal oxides or mixtures thereof or carbon. The contacting is effected in the substantial absence of molecular oxygen and with the scavenger below its thiol-sulfur end point (capacity). The resulting product, surprisingly in view of the prior art, has a thiol content which is in general below about one part per million and usually is about 0.1 part per million. Thus for practical purposes, the resulting product is essentially free of thiol impurity.

By the term "thiol sulfur" as used herein is meant combined sulfur contained in thiol molecules, RSH, where R is a hydrocarbon radical.

EMBODIMENT

In a preferred embodiment, a medium-boiling-range gasoline naphtha obtained from the hydrocracking of a hydrocrackable hydrocarbon mixture and having previously been subjected to catalytic hydrodesulfurization (HDS) conditions is employed as the feed. Sulfur removal during the HDS reaction is equilibrium-limited and is limited by recombination of hydrogen sulfide with olefinic components before hydrogen sulfide separation. Therefore, there is an appreciable content of thiol impurity in the product stream. This product stream usually contains an amount of thiol sulfur in the range from 1 to 500 ppm. For example, a representative hydrodesulfurized feed has a total sulfur content in the range from about 1.2 to 3.0 ppm. This amount of sulfur makes the feed undesirable for use as a feed to a catalytic reformer, for example using a platinum or platinum-rhenium bimetallic catalyst. As a practical matter, all of the sulfur content of this feed is in the form of thiol sulfur. It is contacted with a scavenger in a contacting zone which is maintained at a temperature of about 165° C., at a pressure of about 11 atmospheres absolute and at a liquid hourly space velocity (LHSV) of about 10. The scavenger in a composite of copper chromite disposed upon porous alumina having a surface area of about 200 square meters per gram. The copper content of the composite, calculated as copper metal, is about 14 weight percent. So long as the contacting is carried out with the scavenger below its thiol-sulfur end point (capacity), the resulting product stream has a sulfur content which is about 0.1 ppm. The scavenging is desirably controlled by monitoring the sulfur content of the effluent product stream and discontinuing the contacting when the thiol-sulfur content, calculated as elemental sulfur, exceeds a predetermined value, for example about 0.3 ppm.

The above scavenging of the thiol impurity has a number of advantages: (1) it effectively reduces thiol impurity content of a reformable naphtha feed; and (2) it accomplishes this desirable result without having to subject the feed to additional expensive hydrogenating conditions.

THIOL-SULFUR END POINT

The scavengers of the present invention have been found to effectively absorb thiols, particularly higher-molecular-weight thiols, e.g., $C_5+$ thiols, from relatively dilute thiol-containing hydrocarbon streams. And the absorption remains effective, that is an effluent stream is produced which usually contains less than about 0.1 ppm of thiol sulfur, until 95–99% of the thiol-sulfur capacity of the scavenger has been satisfied. Thereafter the thiol content of the effluent stream rises rapidly and approximates the corresponding value for the feed stream. In effect the scavenger is titrated with the thiols of the feed, and the end point is the appearance of an appreciable amount, that is about 0.1 to 0.2 ppm of thiol sulfur, in the effluent stream. Control of the process is conveniently carried out by monitoring the sulfur content of the effluent product stream using ordinary analytical methods for the determination. Where the feed stream contains an appreciable amount of a sulfur-containing impurity whose source is other than thiol, for example thiophenes, organic sulfides or the like, the effluent product stream has a sulfur content which substantially corresponds to the amount of this non-absorbable material present in the feed. The end point for thiol absorption for such a feed will be an increase in the sulfur content of the effluent stream of from about 0.1–0.2 ppm.

THE SCAVENGER

A satisfactory scavenger for the present process should be essentially insoluble in hydrocarbon oils at the contact temperature employed. Otherwise a tradeoff of one impurity for another is made. Therefore the components of the scavenger, for example the copper and carrier components, should be essentially insoluble (i.e., for practical purposes no appreciable solubility) in hydrocarbon oils in general, and in particular in the process feeds contemplated herein. Scavengers, in general, which satisfy these requirements are contemplated for use in the present process.

A satisfactory scavenger must also have a substantial surface area. Otherwise the number of available thiol absorption sites is too small. Usually when the carrier component or the scavenger per se has a surface area (B.E.T. method) of at least about 20 square meters per gram, sufficient sites will be available for efficient removal of thiol from the process feed. In general, a satisfactory surface area is in the range 20–1000 square meters per gram; preferably it is above about 200 square meters per gram.

THE COPPER COMPONENT

A wide variety of copper components are satisfactory for use in the present process. In general, copper metal and copper compounds essentially insoluble in hydrocarbon oils are satisfactory for use herein and are contemplated for such use. The choice of component, in general, will depend upon matters of convenience, for example, relative ease of the incorporating of the component into or onto the surface of the composite which is the scavenger, for example by impregnation, coprecipitation and the like ordinary means, and, of course, cost factors. Preferably the copper component is at least one of the group consisting of copper metal, copper oxides and copper compounds convertable to copper oxides by ordinary calcination and/or oxidation methods.

Representative copper components suitable for use herein include copper metal, copper compounds such as oxides, phosphate, chromite, chloride, bromide, fluoride, carbonate, molybdate, hydroxide, complex ammonia-containing compounds and the like copper compounds. The relative amounts of the copper and carrier components satisfactory for use herein varies depending upon the particular combination of carrier and copper component employed. In general, the scavenger will contain a major amount of the carrier and a minor amount of the copper component. Usually an effective amount of the copper component, based upon the total weight of the scavenger, is in the range from about 1 to 20 weight percent, calculated as elemental copper, with the balance of the scavenger comprising the carrier component.

THE CARRIER COMPONENT

In general, inorganic materials which are solids at the contact temperature of the present process, which are substantially insoluble in hydrocarbon oils and which have a surface area of at least about 20 square meters per gram are satisfactory for use herein and are contemplated for such use. Preferably the carrier component is selected from the group consisting of carbon, the synthetic and natural refractory oxides of metals of Groups II, III and IV of the Periodic Chart of the Atoms (the Welch Scientific Company) and mixtures thereof. More preferably the carrier component consists essentially of alumina or carbon.

Representative carrier components include alumina, silica, carbon, silica-alumina, boria, kieselguhr, processed diatomaceous earths of commerce, pumice, silicates, and the like having an adequate surface area.

THE FEED

Petroleum refinery hydrocarbon streams and hydrocarbon oils, in general having a total sulfur-impurity content, calculated as elemental sulfur, in the range below 1000 ppm, including an appreciable (i.e., about 0.2 ppm) thiol-sulfur content and boiling in the range from about 10° C. to about 300° C. are satisfactory as feeds for the present process and are contemplated for use herein. Preferably the stream is one having a sulfur-impurity content below 100 ppm obtained by hydrodesulfurizing a sulfur-containing naphtha under ordinary hydrodesulfurization conditions and in which the major portion or substantially all of the sulfur-containing impurity in the refinery hydrocarbon stream is contributed by thiol impurities having a carbon atom content in the $C_5+$ range. In the latter case the present process, in general, results in an effluent product stream having little (i.e., below 0.1 ppm) or no sulfur content.

The presence of dissolved oxygen in the hydrocarbon oil is undesirable because roughly to the extent such oxygen is present at the contacting of the feed with the scavenger, organic disulfide is formed from the thiols present in the feed. Disulfide may be carried along in the resulting effluent product stream. In this case the scavenger is acting as a catalyst to promote oxidation of the thiol rather than as an absorbent. Similarly, there should be little or no molecular oxygen present from any other possible source at the contacting of the feed with the scavenger and for the same reasons.

Representative hydrocarbon feeds satisfactory for use in the present process include straight run and refined petroleum naphthas, hydrocrackate product streams and fractions thereof, diesel oil, jet fuel oil, kerosene and the like hydrocarbon streams having the sulfur impurity and boiling point characteristics as discussed above. In a most preferred aspect of the present invention, the feed to the present process is one which after being subjected to the present treatment is to be subjected to catalytic reforming over a platinum-containing or a bimetallic reforming catalyst.

PROCESS CONDITIONS

The contacting of the hydrocarbon feed stream may be carried out in any suitable manner with the hydrocarbon in the liquid or gaseous state or in mixtures thereof and with the scavenger in the fixed-bed or fluid-bed aspect and under ordinary fixed-bed or fluid-bed contacting conditions. Preferably the feed is in the liquid phase, under which condition the higher-molecular-weight thiols are very effectively removed.

A. Temperature

Temperatures satisfactory for use in the present process vary over a considerable range. In general a temperature in the range 120° to 400° C. will be satisfactory. Preferably the temperature is in the range 130°–200° C. and more preferably is about 165° C.

B. Pressure

In general a suitable pressure will depend upon whether or not the hydrocarbon feed at the contacting is in the liquid or gaseous phase. In the former case, the pressure necessarily must be at least sufficient to maintain the desired liquid phase. Preferably, the contacting is effected at a pressure sufficient to maintain at least the major portion of the feed in the liquid phase.

C. Contact Time

The contact time desirably used in the present process varies depending upon a number of factors, including the particle size, the surface area and pore size of the porous carrier used in the preparation of the scavenger, the relative amount of thiol sulfur present in the hydrocarbon feed and the like. In general, a satisfactory contact time will result when the liquid hourly space velocity (LHSV) is in a range from about 0.1–50, preferably 1–40, and the average particle diameter of the carrier is in the range from about 0.004 to 7 mm, preferably 0.7 to 6 mm.

SCAVENGER REGENERATION

The scavengers of the present invention, after becoming spent in service by reaching the thiol end point, may be regenerated in any suitable manner. Whether or not it is desirable to regenerate the scavenger is a matter of economics and of the availability of materials required to manufacture a replacement scavenger. Where the scavenger is to be regenerated, it is especially desirable that it contain a catalytic oxidizing component, for example chromium in the chromite or oxide form, a molybdenum oxide, or the like. Such a component appears to facilitate oxidation of the sulfur impurity. The regeneration is desirably carried out in the following stages:

1. Stripping adhering hydrocarbon from the scavenger;
2. Subjecting the spent scavenger to oxidizing conditions in the presence of molecular oxygen; and
3. Subjecting the oxidized scavenger to reducing conditions in the presence of molecular hydrogen gas.

In stripping the adhering hydrocarbon from the spent scavenger, a suitable agent is a gas such as nitrogen, hydrogen, steam or carbon dioxide. The stripping is conveniently carried out at a temperature reasonably approximate to the temperature employed for the thiol absorption stage, for example as in the embodiment described above at about 165° C. To facilitate prompt evaporation of the adhering hydrocarbon, the system pressure is desirably reduced. When the effluent gas stream from the stripping is more or less free of hydrocarbons, the spent scavenger is ready for the next stage of the regeneration.

The purpose of the oxidizing stage in the regeneration of the spent scavenger is twofold: (i) to oxidize residual carbon and hydrocarbon containing materials adhering to the scavenger; and (ii) to oxidize the residual sulfur in whatever form present. For this purpose a dilute molecular oxygen-containing gas stream is employed, for example one which contains from 1 to 2 volume percent of molecular oxygen. The reason that a dilute molecular oxygen gas stream is employed is to avoid and to control the exothermic heat of reaction which accompanies the desired oxidations. In this way a "slow burn" is obtained and the temperature of the spent scavenger is maintained at a reasonable level, for example in the range from about 190° to 260° C. The oxidation is complete when the effluent gas stream has substantially the same composition as the feed stream employed for the oxidation stage.

For the final stage of the regeneration, the oxidized spent scavenger is desirably purged using a stream of nitrogen gas in order to remove most if not all of the molecular oxygen gas remaining in the scavenger. The purpose of the reducing stage is to convert the metal sulfur oxide moiety present in and/or on the scavenger to sulfur dioxide, which is carried away in the effluent gas stream leaving the copper component of the scavenger in the form of copper oxide and/or copper metal. The reducing stage of the regeneration is complete when for practical purposes the effluent gas stream contains little or no sulfur dioxide gas. At this stage the scavenger is regenerated and ready for use in the removal of thiol impurities from a hydrocarbon stream. As in the case of the oxidation stage of the regeneration, it is desirable to avoid a temperature excursion in the reactor, and to this end nitrogen containing but a few volume percent of hydrogen is employed for the initial stages of the reduction, the hydrogen concentration being increased with time. A temperature of the order of 188° C. and a pressure in the range 5.4–6.4 atmospheres is suitable for the reduction stage. Reasonably higher and lower temperatures and pressures may also be employed.

EXAMPLES

The following examples are submitted for the further demonstration but not the limitation of the invention.

EXAMPLE 1

In this example the effective removal of thiol impurity from a cracked gasoline boiling in the 93° C.–177° C. range is demonstrated. This gasoline contained 1.2 ppm of sulfur which was nearly all present as thiol impurity. The scavenger employed was copper chromite disposed upon porous alumina having a surface area of about 180 $m^2$ per gram. It contained 14 and 3.4 weight percent of copper and chromium, respectively, calculated as the metals. The contacting of the gasoline with the scavenger was at a temperature of about 165° C., a pressure of about 11 atmospheres and a liquid hourly space velocity (LHSV) of about 10. For a period of over 900 hours, the effluent product stream contained no detectable thiol impurity and the non-thiol sulfur-impurity content of this product was less than 0.1 ppm. Thereafter the thiol content of the product stream increased rapidly, indicating that the thiol end point of the scavenger had been reached. At the time of the thiol break-through, the scavenger contained 1.2 weight percent sulfur based on the absorbent.

EXAMPLE 2

Example 1 was repeated except that the LHSV was increased to 40. As in Example 1, the effluent product stream contained no detectable thiol impurity. The thiol break-through was experienced after about 580 hours on stream and the spent scavenger contained 2.25 weight percent sulfur.

EXAMPLE 3

Using a scavenger as described in Example 1, a sulfur-containing $C_5-127°$ C. naphtha was used as the feed. It had a total sulfur content of 340 ppm of which 58 ppm was in the form of thiol impurity. The contact conditions included a pressure sufficient to maintain the feed in the liquid phase, i.e., of 14.6 atmospheres, an LHSV of 1.0 and a temperature of 260° C. The effluent product stream contained no detectable thiol impurity until break-through, which occurred after about 350 hours on stream. At this time the spent scavenger contained about 2.7 weight percent of sulfur.

EXAMPLE 4

Example 3 was repeated except that the feed was a $C_5+-71°$ C. naphtha having a total sulfur content of 190 ppm of which 83 ppm was in the form of thiols. The thiol break-through occurred after about 270 hours on stream, at which time the spent scavenger contained about 2.7 weight percent sulfur.

EXAMPLE 5

Example 4 was repeated except that the contact temperature was 149° C. The thiol break-through again occurred after about 270 hours, at which time the spent scavenger contained about 2.4 weight percent of sulfur. After the break-through, the rate of increase in the thiol content of the effluent stream was markedly slower than in the case of Example 4.

EXAMPLE 6

Example 4 was repeated except that the contact temperature was 93° C. As in the previous Examples 4 and 5, the effluent product stream contained no thiol impurity except that even after 360 hours on stream no thiol break-through had occurred. On the other hand, after only 150 hours on stream the sulfur content of the effluent stream increased rapidly and approximated that of the feed. Therefore, rather than absorbing thiol, the scavenger was catalyzing thiol conversion to some other sulfur-containing material, apparently organic sulfides.

EXAMPLE 7

Example 4 was repeated except that the feed contained 550 ppm of sulfur of which 110 ppm was in the form of thiol sulfur. The thiol break-through occurred after about 190 hours on stream at which time the sulfur content of the spent scavenger was about 2.3 weight percent.

The above examples demonstrate that the conditions of the present process may vary widely: (1) a suitable temperature for the contacting is one which is substantially above 95° C.; (2) the absorption of thiols is rapid, and is effectively accomplished over a wide range of LHSV values; and (3) the presence of a substantial amount of sulfur-containing impurity in the feed other than thiols, while undesirable, does not interfere unduly with thiol absorption by the subject scavengers. The composition of the carrier component may vary widely, provided that it is porous and presents a substantial surface area for the disposition of absorbent scavengers comprising copper. The hydrocarbon feed stream may contain a minor amount of water or water vapor. Preferably the contacting of the hydrocarbon with the scavenger is carried out under substantially anhydrous conditions, that is, in the presence of little or no water. Water in a minor amount, such as is ordinarily present in a conventional hydrocarbon hydroprocessing product stream, does not appear to interfere with the desired thiol absorption.

What is claimed is:

1. In the production of a hydrocarbon reformate from a hydrocrackable hydrocarbon oil by steps, including hydrodesulfurizing said oil, subjecting the resulting hydrodesulfurized oil to ordinary hydrocracking conditions and reforming the resulting hydrocrackate under platinum catalyzed hydrocarbon reforming conditions, the improvement comprising producing an improved feed for said reforming by removing residual thiol sulfur from said hydrocrackate by contacting said hydrocrackate in the liquid phase with a thiol scavenger, said hydrocrackate having a total sulfur-containing impurity content, calculated as sulfur, in the range below 1000 ppm, including at least 0.2 ppm of thiol impurity, said contacting being in the substantial absence of molecular oxygen and at a temperature in the range of from about 120° C. to 400° C., said scavenger comprising an essentially oil-insoluble solid composite having (1) a copper component and (2) a porous carrier component, having a surface area in the range of from about 20 to 1000 square meters per gram, said copper component being at least one thiol absorbing material selected from the group consisting of copper metal and copper compounds, and said carrier component being at least one carrier selected from the group consisting of inorganic refractory metal oxides and carbon, said contacting being continued so long as the resulting effluent oil has a thiol-sulfur content, calculated as sulfur, in the range below about 0.2 ppm.

2. A process as in claim 1 wherein said copper compounds are convertible to copper oxides by calcination or oxidation.

3. A process as in claim 1 wherein said carrier component consists essentially of alumina.

4. A process as in claim 1 wherein said carrier component consists essentially of carbon.

5. A process as in claim 1 wherein said thiol impurity has a carbon atom content in the $C_5+$ range.

6. A process as in claim 1 wherein said contacting is at a temperature in the range from about 130° to 200° C.

7. A process as in claim 1 wherein said contacting is at a temperature of about 165° C.

8. A process as in claim 1 wherein said scavenger is copper chromite on alumina.

9. A process as in claim 1 wherein said scavenger contains an amount of the copper component, calculated as copper metal, in the range from about 1 to 20 weight percent based on the composite.

10. A process as in claim 1 wherein said copper component is copper chromite.

* * * * *